US012262797B2

(12) United States Patent
Haider et al.

(10) Patent No.: US 12,262,797 B2
(45) **Date of Patent: *Apr. 1, 2025**

(54) QUICK-RELEASE LATCHES

(71) Applicant: Aspetto, Inc., Fredericksburg, VA (US)

(72) Inventors: Abbas Haider, Fairfax, VA (US); Robert Imre Davis, Locust Grove, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/155,172

(22) Filed: Jan. 17, 2023

(65) Prior Publication Data

US 2023/0225463 A1 Jul. 20, 2023

Related U.S. Application Data

(60) Provisional application No. 63/300,239, filed on Jan. 17, 2022.

(51) Int. Cl.
*A44B 17/00* (2006.01)

(52) U.S. Cl.
CPC ..... *A44B 17/0041* (2013.01)

(58) Field of Classification Search
CPC ..... A44B 17/0041; A44B 11/266
See application file for complete search history.

(56) References Cited

U.S. PATENT DOCUMENTS 4,928,364 A * 5/1990 Ikeda ..... A44B 11/2592 24/615
5,440,792 A * 8/1995 Ida ..... A44B 11/263 24/615
5,551,131 A 9/1996 Anscher
5,832,573 A * 11/1998 Howell ..... A44B 11/2526 24/616
5,855,057 A 1/1999 Anscher
6,637,083 B1 10/2003 Howell
10,104,943 B2 * 10/2018 Haider ..... A44B 11/2592
10,765,176 B2 * 9/2020 Castiglione ..... A41D 13/1161
2012/0017347 A1 1/2012 Strum et al.
2016/0000191 A1 1/2016 Haider et al.
2022/0349431 A1 * 11/2022 Haider ..... F16B 21/073

OTHER PUBLICATIONS

International Search Report and Written Opinion in related PCT Application No. PCT/US2023/60720 mailed May 17, 2023.

* cited by examiner

*Primary Examiner* — David M Upchurch
(74) *Attorney, Agent, or Firm* — Sam Pierce

(57) ABSTRACT

A quick-release latch may include a male component and a female component. The male component may include an insertable male portion comprising a top wall, a bottom wall, and one or more sidewalls. The male component may also include a first strap attachment portion defining a first plurality of strap openings each having a laterally extending strap slot and a mouth positioned off-center of and providing exterior access to the respective strap slot. The female component may include a female receptacle portion comprising a top wall, a bottom wall, and one or more sidewalls collectively forming a receptacle configured to receive and releasably lock to the insertable male portion of the male component. The top wall of the female receptacle may include a cantilever wall partially surrounded by one or more slots. The cantilever wall may extend proximate a same plane as the top wall.

20 Claims, 10 Drawing Sheets

QUICK-RELEASE LATCHES

CROSS-REFERENCE TO RELATED APPLICATIONS

This application claims priority under 35 U.S.C. § 119 to U.S. Provisional Patent Application No. 63/300,239, filed Jan. 17, 2022, the entire contents of which are fully incorporated herein by reference.

FIELD OF THE INVENTION

The disclosed technology generally relates to quick-release latches and other connectors, and more particularly to quick-release latches and other connectors having mating components with increased durability.

BACKGROUND

Latches and other types of connectors of various forms are often used as fasteners on a variety of items, such as clothing, bags, backpacks, seatbelts, and the like. Latches suited for these purposes often have a locking mechanism that can be selectively released (e.g., via a lever or press tabs) to allow the matching components of the latch to disengage. Existing latches can be cumbersome to release, often requiring significant force and/or an odd movement from a user to selectively release the mated components. These limitations can prove disadvantageous in situations where a user must be able to quickly disconnect opposing components of a latch, such as for safety reasons (e.g., on body armor, military or law enforcement uniforms, safety vests, etc.). Further, the static nature of existing latches may limit performance for the item on which the latch is equipped (e.g., by limiting its range of motion and flexibility) and be uncomfortable to the user wearing or interacting with the item. The force required to open existing latches commonly causes these latches to break. These limitations become more significant for particular professions that require superior performance and/or wearing an item over long periods of time (e.g., law enforcement, military, professional sports, etc.).

Accordingly, there is a need for improved quick-release latches that address the above-mentioned deficiencies. Embodiments of the present disclosure are directed to these and other considerations.

SUMMARY OF THE INVENTION

The disclosed technology provides quick-release latches. In one example embodiment, the disclosed technology provides a quick-release latch including a male component and a female component that selectively engage with each other. The male component may include an insertable male portion comprising a top wall, a bottom wall, and one or more sidewalls. At least a portion of the top wall may longitudinally taper towards the bottom wall proximate a front edge. The male component may also include a first strap attachment portion defining a first plurality of strap openings each having a laterally extending strap slot and a mouth positioned off-center of and providing exterior access to the respective strap slot. The female component may include a female receptacle portion comprising a top wall, a bottom wall, and one or more sidewalls collectively forming a receptacle configured to receive and releasably lock to the insertable male portion of the male component. The top wall of the female receptacle may include a cantilever wall partially surrounded by one or more slots. The cantilever wall may extend proximate a same plane as the top wall. The female component may also include a second strap attachment portion defining a second plurality of strap openings each having a laterally extending strap slot.

In another example embodiment, a quick-release latch may include a female connector and a male connector. The female connector may include a female receptacle body comprising a top wall, a bottom wall, and one or more sidewalls collectively forming a receptacle, the top wall comprising a cantilever wall having one or more downwardly extending contact protrusions. The female connector may also include one or more strap attachment sections positioned adjacent the female receptacle body, the one or more strap attachment sections comprising a laterally extending strap slot. The male connector may include a base comprising a forward-facing lip, a first strap opening, and a second strap opening. The first strap opening may have a first laterally extending strap slot and a first rearwardly-facing mouth positioned off-center of the first strap slot. The second strap opening may have a second laterally extending strap slot and a second rearwardly-facing mouth positioned off-center of the second strap slot. The male connector may also include a blade protruding from the forward-facing lip of the base. The blade may include a top wall, a bottom wall, and one or more sidewalls. A front portion of the top wall longitudinally may taper towards the bottom wall proximate a front edge and the bottom wall comprises one or more contact cavities configured to engage the one or more contact protrusions of the cantilever wall of the female receptacle body when the blade is fully inserted into the female receptacle body.

In another example embodiment, a quick-release latch may include a female connector and a male connector. The female connector may include a female receptacle formed by one or more outer walls that may include a cantilever wall having one or more downwardly extending contact protrusions. The female connector may also include one or more strap attachment sections positioned adjacent the female receptacle. The one or more strap attachment sections may include a strap slot. The male connector may include a base that may include a first strap attachment section and a second strap attachment section. The first strap attachment section may have a first strap slot and a first rearwardly-facing mouth positioned off-center of the first strap slot. The second strap attachment section may have a second strap slot and a second rearwardly-facing mouth positioned off-center of the second strap slot. The male connector may also include a blade protruding from the base opposite the first and second rearwardly-facing mouths. The blade may include an outer wall having one or more contact cavities configured to contact the one or more contact protrusions of the cantilever wall of the female receptacle when the blade is at least partially inserted into the female receptacle.

The corresponding features of the male and female components may enable the male component to be inserted into and engaged by the female component when the components are in a connection position and selectively released from the female component when the components are in a disconnected or detached position. The shape and relative arrangement of the corresponding features may also enable the male and female components to connect with and secure with one or more straps to provide increased performance (e.g., greater force resistance for strap retaining component) and user comfort of the item (e.g., clothing, vest, backpack, etc.) to which the latch is affixed while still being configured to quickly release with a simple and convenient single motion of the user. For example, for a latch on a vest, a user may be able to pull a rope threaded through a hole in the cantilever wall away from his or her body in a single motion that both disengages the corresponding features of the male and female components and at least partially removes the vest from his or her torso.

BRIEF DESCRIPTION OF THE DRAWINGS

Reference will now be made to the accompanying figures, which are not necessarily drawn to scale, and wherein.

DETAILED DESCRIPTION

Some implementations of the disclosed technology will be described more fully with reference to the accompanying drawings, which form a part hereof, and in which is shown by way of illustration various example embodiments in which aspects of the disclosure may be practiced. It is to be understood that other embodiments may be utilized, and structural and functional modifications may be made without departing from the scope of the present disclosure. Aspects of the disclosure are capable of other embodiments and of being practiced or being carried out in various ways. In addition, it is to be understood that the phraseology and terminology used herein are for the purpose of description and should not be regarded as limiting. Rather, the phrases and terms used herein are to be given their broadest interpretation and meaning.

By way of introduction, aspects discussed herein may relate to quick-release latches and other connectors, including those having first (e.g., male) and second (e.g., female) components configured to engage one another. These types of latches may also better allow a user to quickly disconnect the opposing components of the latch, such as for safety reasons (e.g., on body armor, military or law enforcement uniforms, safety vests, etc.). As such, the following discussion describes exemplary embodiments of a quick-release latch incorporating one or more of the above-described features.

As shown in FIGS. 1A-1D, 2A-2D, 3A-3C, quick-release latch 10 may include a male component 100 and a female component 200 designed to selectively connect with and detach from one another. Male component 100 and female component 200 may be constructed out of any known material, including plastics (e.g., Acrylonitrile Butadiene Styrene (ABS), high-density polyethylene, polystyrene, etc.), metals, carbon fiber and other composites, and combinations thereof, based on desired strength, toughness, impact resistance, heat resistance, and manufacturing cost. For example, ABS may be best suited in applications that require strength, toughness, impact resistance, and/or heat resistance while still being light and inexpensive to manufacture. High-density polyethylene may be best suited in applications that require good ductility, tensile strength, and impact and heat resistance. Polystyrene may be best suited in applications where impact resistance is the top priority. In some embodiments, male component 100 and/or female component 200 may each be cast or rotationally molded as a continuous single material (e.g., of a hard plastic or carbon fiber). In other embodiments, male component 100 and/or female component 200 may each be assembled from a plurality of parts made of different materials.

Figure 1A:
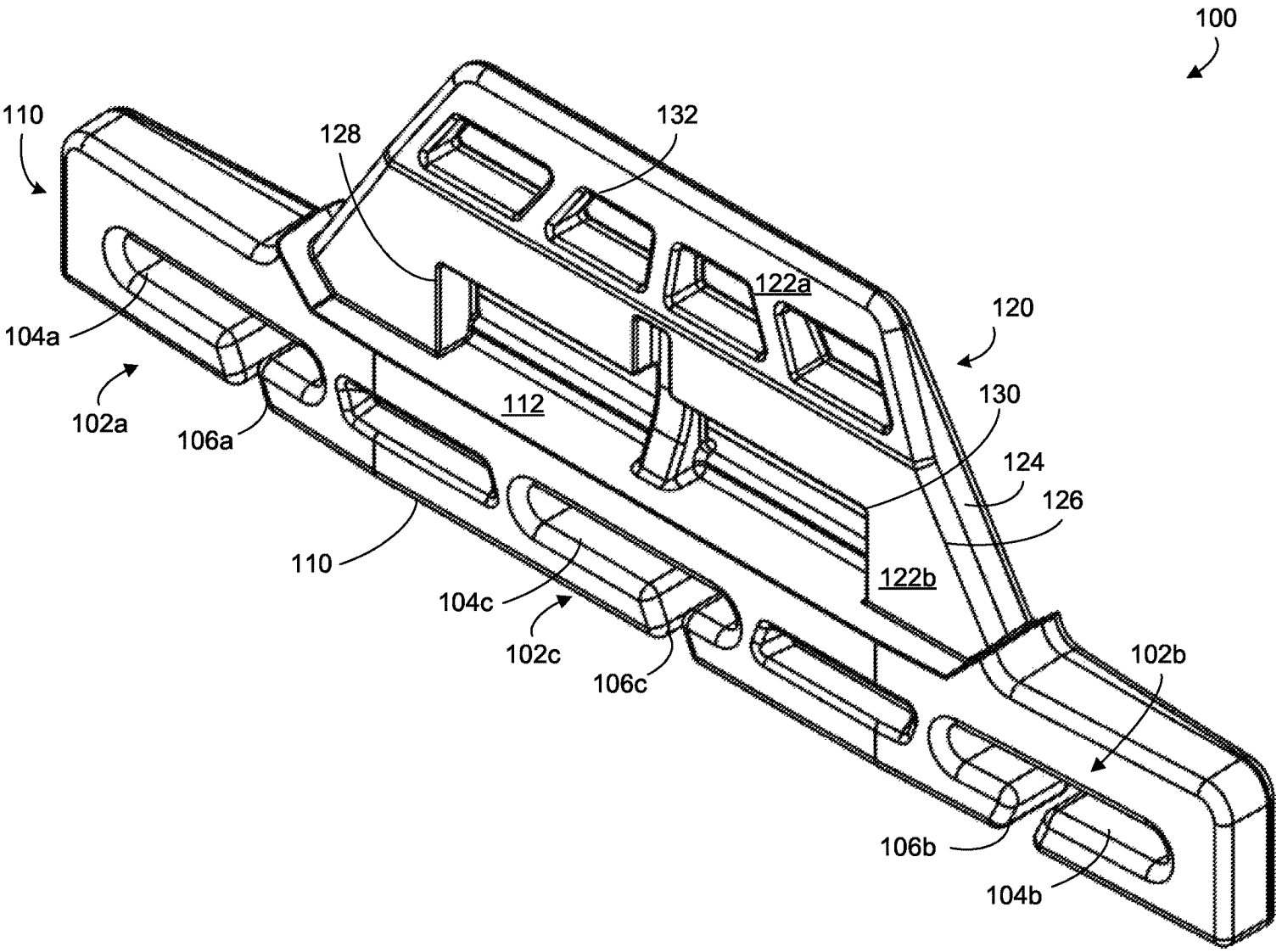
FIGS. 1A-1D show a top isometric (1A), front (1B), top (1C), and side (1D) views of male component of a quick-release latch in accordance with one or more embodiments of the present disclosure.
Figure 1B:
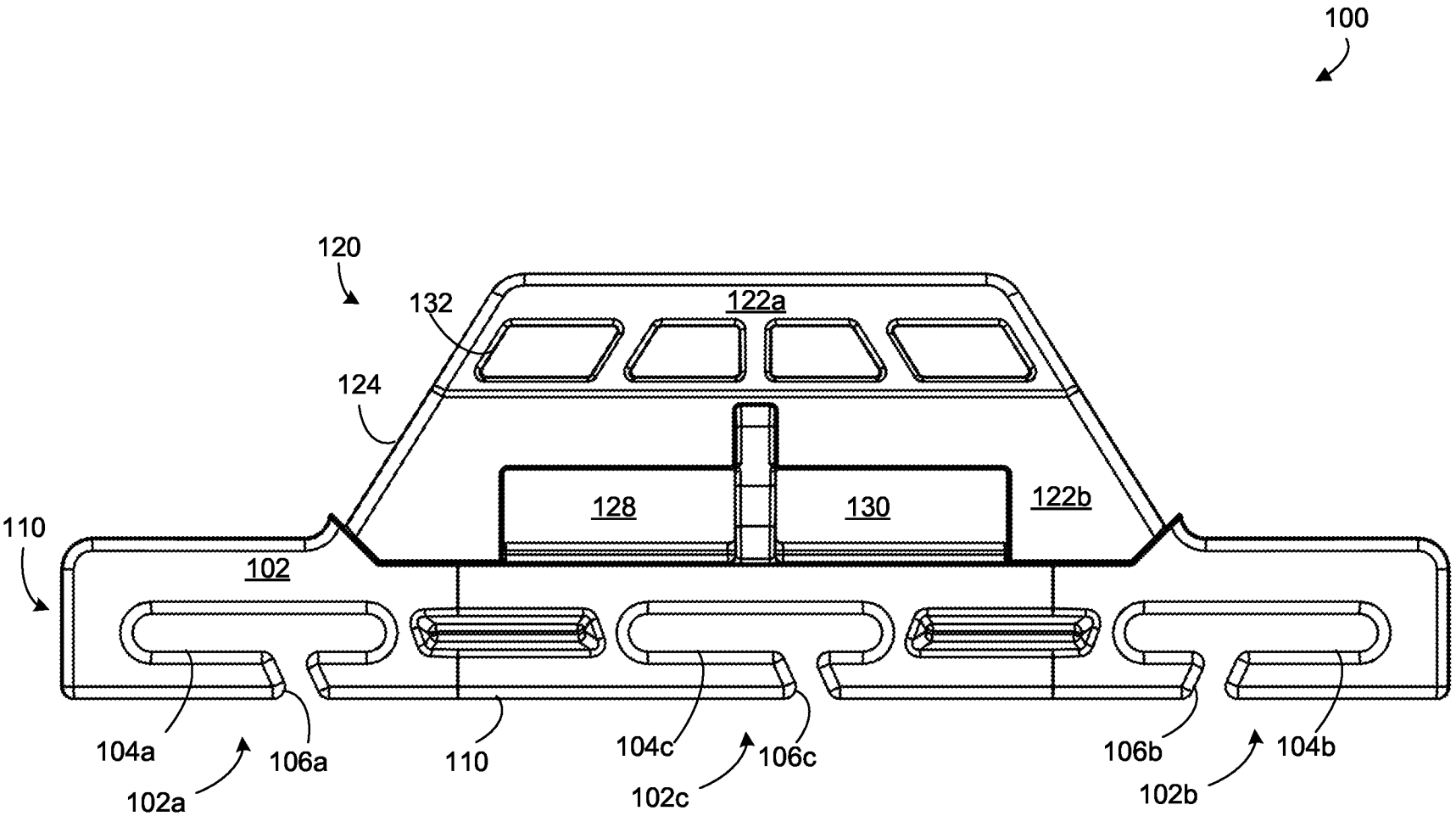
Figure 1C:
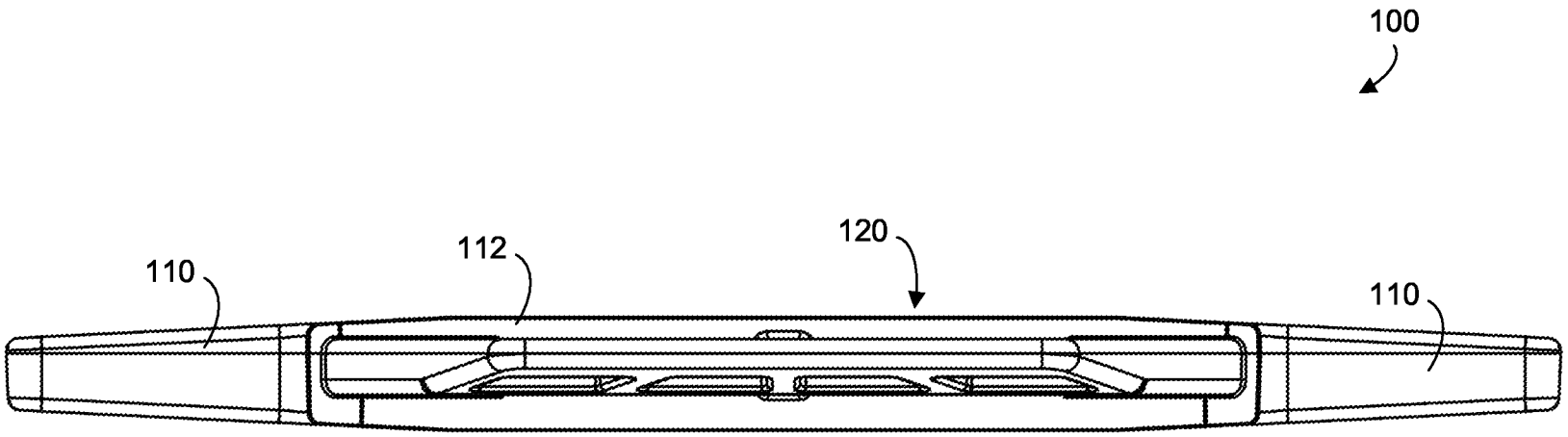
Figure 1D:
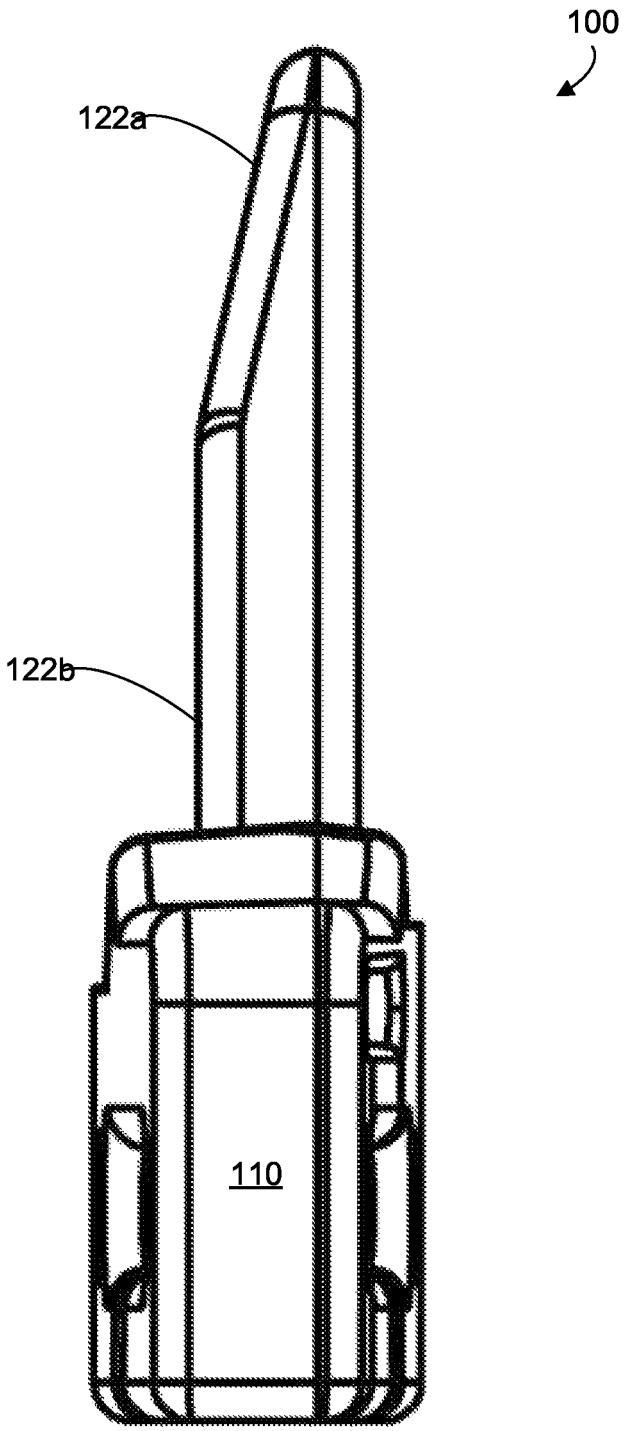

As shown more clearly in the top isometric and front views of FIGS. 1A and 1B, respectively, the male component 100 may include a base 110. The base 110 may include a first strap attachment section 102*a* and a second strap attachment section 102*b*. The first strap attachment section 102*a* may include a first strap slot 104*a* and a first rearwardly facing mouth 106*a* positioned off-center of the first strap slot 104*a*. The second strap attachment section 102*b* may include a second strap slot 104*b* and a second rearwardly facing mouth 106*b* positioned off-center of the second strap slot 104*b*. The base 110 may also a third strap attachment section 102*c*, which may include a third strap slot 104*c* and a third rearwardly facing mouth 106*c* positioned off-center of the third strap slot 104*c*.

Put another way, a first strap attachment portion 110 may define a first plurality of strap openings 102*a*, 102*b*, 102*c*, each of which may have a laterally extending strap slot 104*a*, 104*b*, 104*c* and a mouth 106*a*, 106*b*, 106*c* positioned off-center of an providing exterior access to the respective strap slot 104*a*, 104*b*, 104*c*. Although three first strap openings 102*a*, 102*b*, 102*c* are shown, the male component 100 may include only two first strap openings such as a left-most strap opening 102*a* and a right-most strap opening 102*b* or may include three or more as shown. Regardless, an insertable male portion 120 (described below) may be positioned between the mouth 106*a* of the left most strap opening 102*a* and the mouth 106*b* of the right most strap opening 102*b*. Each mouth 106*a*, 106*b*, 106*c* of the first plurality of strap openings may bisect each of the respective laterally extending strap slots 104*a*, 104*b*, 104*c* into a minority strap slot portion and a majority strap slot portion. Each of the mouths 106*a*, 106*b*, 106*c* of the first plurality of strap openings 102*a*, 102*b*, 102*c* may be angled towards the majority strap slot portion such that it forms an acute angle with the minority strap slot portion, which can help make intentional insertion and removal of the straps into the respective strap openings 102*a*, 102*b*, 102*c* easier while minimizing the risk of unintentional removal of the straps. The acute angle may be between 25 and 85 degrees. Depending on the thickness and rigidity of the straps as well as the frequency of their insertion and removal from the first strap attachment portion 110, the acute angle may be between 25 and 45 degrees to facilitate easier strap insertion and removal or between 65 and 85 degrees to make unintentional removal of the straps more difficult. It is contemplated that the mouths 106*a*, 106*b*, 106*c* of the first plurality of strap openings 102*a*, 102*b*, 102*c* may have different acute angles (e.g., mouths 106*a* and 106*b* between 25 and 45 degrees and mouth 106*c* above 45 degrees) to make unintentional removal of all three straps even more difficult than if they shared a common angle.

The base 110 may also include a forward-facing lip 112, a first strap opening 102*a*, and a second strap opening 102*b*. The first strap opening 102*a* may include a first laterally extending strap slot 104*a* and a first rearwardly-facing mouth 106*a* positioned off-center of the first strap slot 104*a*.

The second trap opening 102*b* may include a second laterally extending strap slot 104*b* and a second rearwardly-facing mouth 106*b* positioned off-center of the second strap slot 104*b*. The blade 120 may protrude from the forward-facing lip 112 of the base 110. The blade may include a top wall 122*a*, a bottom wall 122*b*, and one or more sidewalls 124. A front portion of the top wall 122*a* may longitudinally taper towards the bottom wall 122*b* proximate a front edge 126 and the bottom wall 122*b* may include one or more contact cavities 124 configured to engage the one or more contact protrusions of the cantilever wall of the female receptacle body when the blade is fully inserted into the female receptacle body.

The first mouth 106*a* of the first strap opening 102*a* may bisect the first strap slot 104*a* into a minority first strap slot portion and a majority first strap slot portion. The second mouth 106*b* of the second strap opening 102*b* may bisect the second strap slot 104*b* into a minority second strap slot portion and a majority second strap slot portion. The first mouth 106*a* may be angled inwardly toward the majority first strap portion such that it forms an acute angle with the minority first strap portion as described above. Similarly, the second mouth 106*b* may be angled inwardly toward the minority second strap portion such that it forms an acute angle with the minority first strap portion. The outlet and inlet ends of the first mouth 106*a* may be between an innermost edge of first strap slot 104*a* and center of first strap slot 104*a*. Similarly, outlet and inlet ends of second mouth 106*b* may be between an innermost edge of second strap slot 104*b* and center of second strap slot 104*b*. The first strap slot 104*a* may be positioned outside of a leftmost bounds of the blade 120 and the second strap slot 104*b* may be positioned outside of a rightmost bounds of the blade 120. The base may be thicker 110 than the blade 120.

The first strap slot 104*a* and the second strap slot 104*b* are aligned in a lateral direction. The first mouth 106*a* may have first planar surfaces non-perpendicular to the first strap slot 104*a* and the second mouth 106*b* may have second planar surfaces non-perpendicular to the second strap slot 104*b*. As previously mentioned, the base 110 of the male connector 100 may include a third strap opening 102*c*. The third strap opening 102*c* may be positioned on a lateral center of the male connector 100, the third strap opening 102*c* may include a third laterally extending strap slot 104*c* and a third rearwardly-facing mouth 106*c*. The third mouth 106*c* may be positioned off-center of the third strap slot 104*c*. The one or more contact cavities 124 of the male connector 100 may include a laterally-aligned left contact cavity 128 and a laterally-aligned right contact cavity positioned off 130 of a central longitudinal axis of the male connector 100.

The male component 100 may also include a blade 120 that may protrude from the base 110 opposite the first and second rearwardly-facing mouths. The blade 120 may include one or more cavities 124 configured to contact one or more contact protrusions 332 of the cantilever wall 202*a* of the female receptacle 204 of the female receptacle 202 when the blade 120 is at least partially inserted into the female receptacle 202. Put another way, an insertable male portion 120 may include a top wall 122*a*, a bottom wall 122*b*, and one or more side walls 124. At least a portion of the top wall 122*a* may longitudinally taper towards the bottom wall 122*b* proximate a front edge 126 of the insertable male portion 120.

As shown in FIGS. 2A-2D, the female component 200 may include a female receptacle portion. The female receptacle portion 202 may include a top wall 204, a bottom wall 206, and one or more sidewalls 208 collectively forming a receptacle configured to receive and releasably lock to the insertable male portion 120 of the male component 100. The top wall 204 may include a cantilever wall 210 partially surrounded by one or more slots 212. The cantilever wall 210 may extend proximate a same plane as the top wall 204. The top wall 204 may include a second strap attachment portion 214 defining a second plurality of strap openings 216*a*, 216*b* each having a laterally extending strap slot 218*a*, 218*b*.

The female connector 200 may include a female receptacle body 202 that includes a top wall 204, a bottom wall 206, and one or more sidewalls 2018 collectively forming a receptacle. The top wall 204 may include a cantilever wall 210. As shown in FIG. 2C, the cantilever wall 210 may include one or more downwardly extending contact protrusions 222*a*, 222*b*. The female connector 200 may also include one or more strap attachment sections 214 positioned adjacent the female receptacle body 202, the one or more strap attachment sections 214 may include a laterally extending strap slot 218*a*, 218*b*. The one or more strap attachment sections 214 may include a pair of strap attachment sections 214 laterally positioned on opposing sides of the female receptacle body 202. As shown in FIG. 2C, the one or more downwardly extending contact protrusions 222*a*, 222*b* of the female connector 200 may include a laterally aligned left contact protrusion 222*a* and a laterally aligned right contact protrusion 222*b* positioned off of a central longitudinal axis of the female connector.

The female connector 200 may include a female receptacle 202 formed by one or more outer walls 204, 206, and 206. The female receptacle 202 may include a cantilever wall 210. The cantilever wall 210 may include one or more downwardly extending contact protrusions 222*a*, 222*b* as shown in FIG. 2C. The female connector 200 may also include one or more strap attachment sections 214 positioned adjacent the female receptacle 202. The one or more strap attachment sections 214 may include one or more strap slots 218*a*, 218*b*.

Figure 2A:
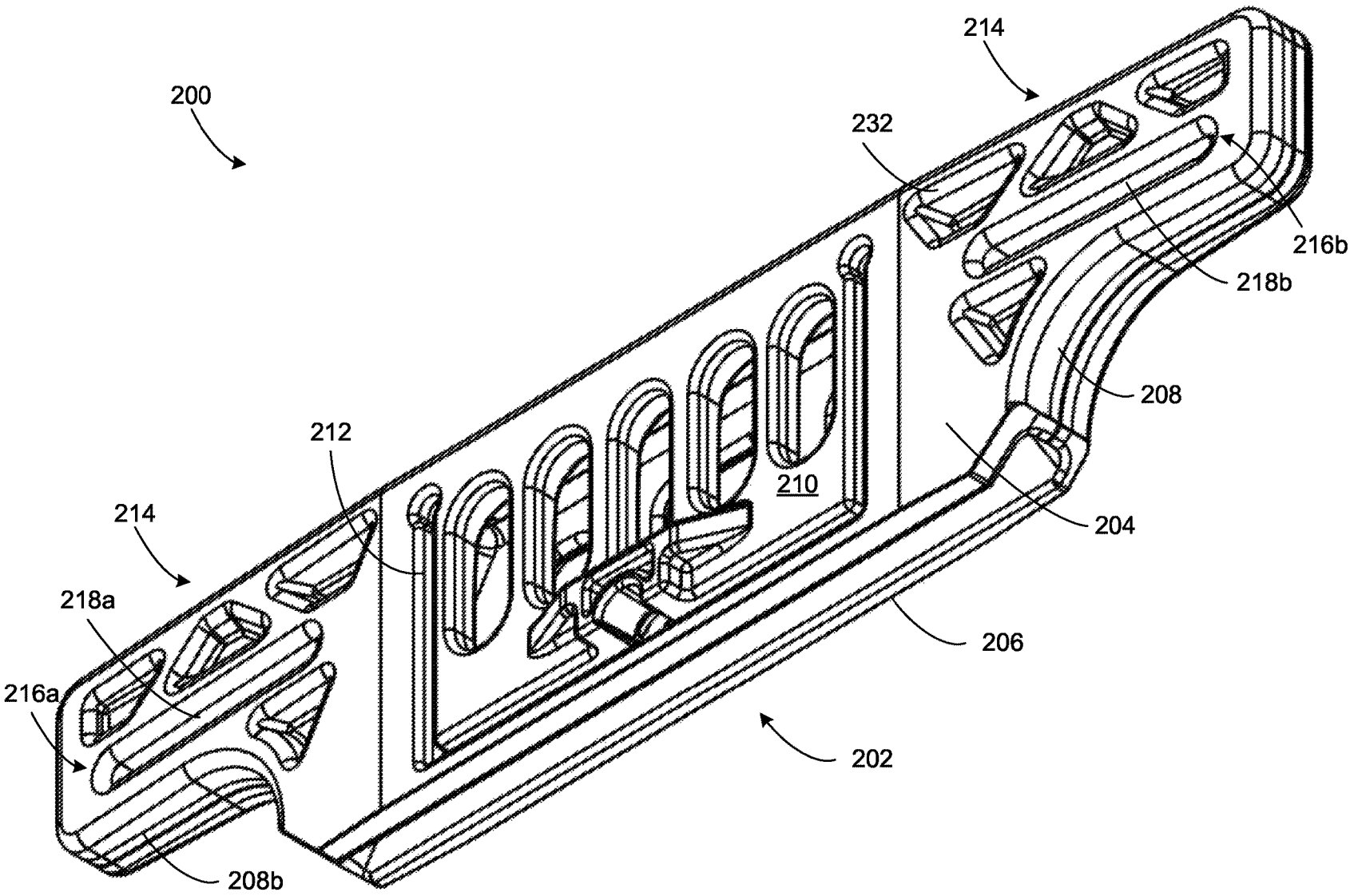
FIGS. 2A-2D show a bottom isometric (2A), front (2B), bottom (2C), and side (2D) views of female component of a quick-release latch in accordance with one or more embodiments of the present disclosure.
Figure 2B:
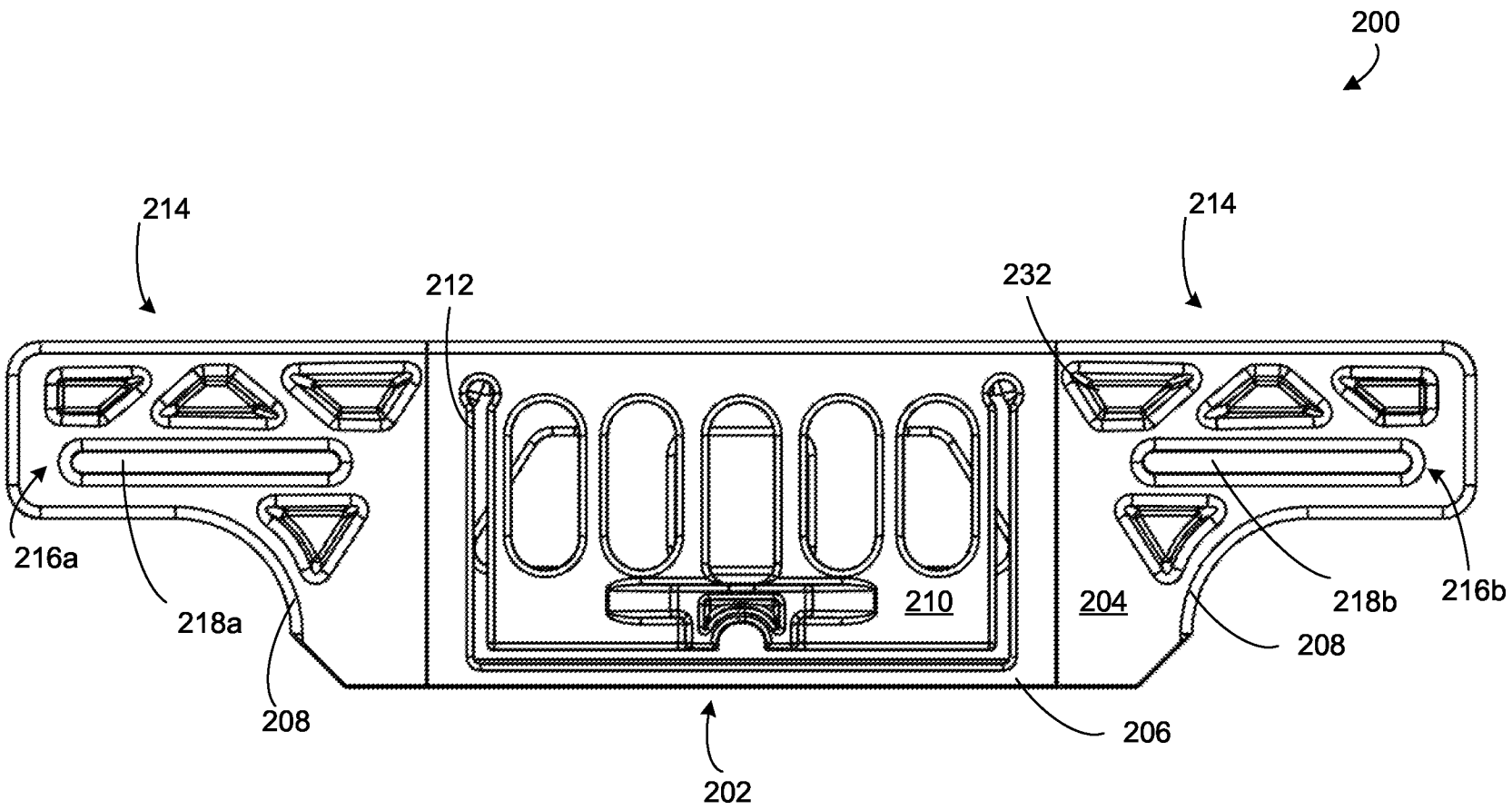
Figure 2C:
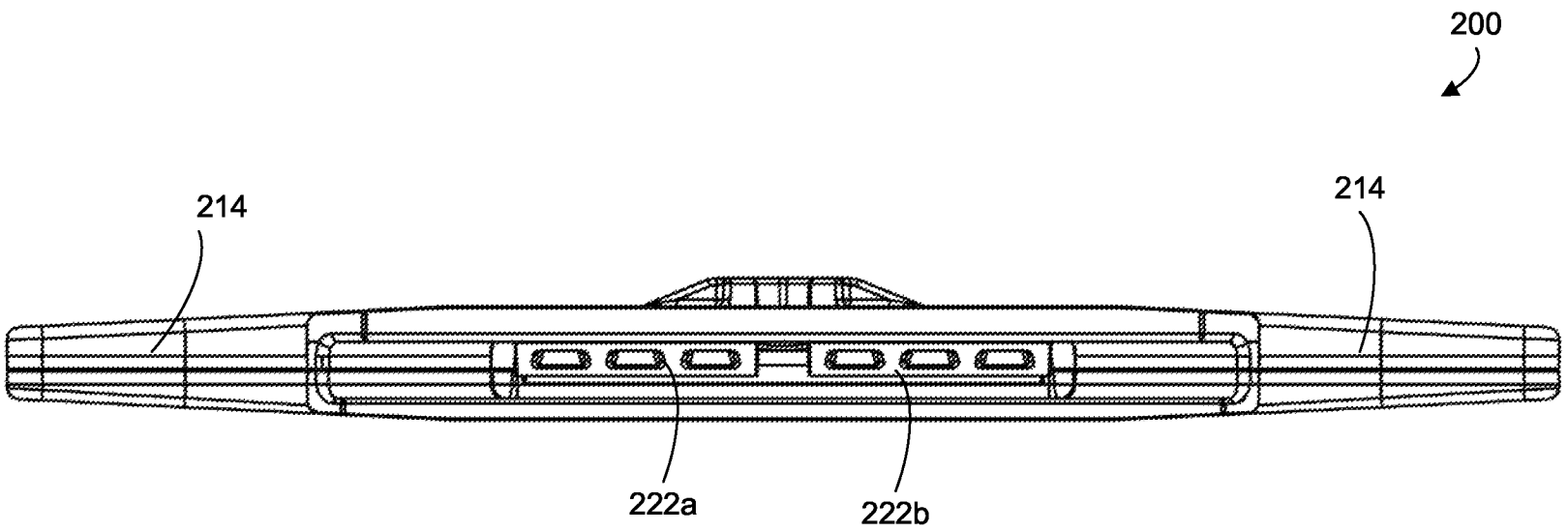
Figure 2D:
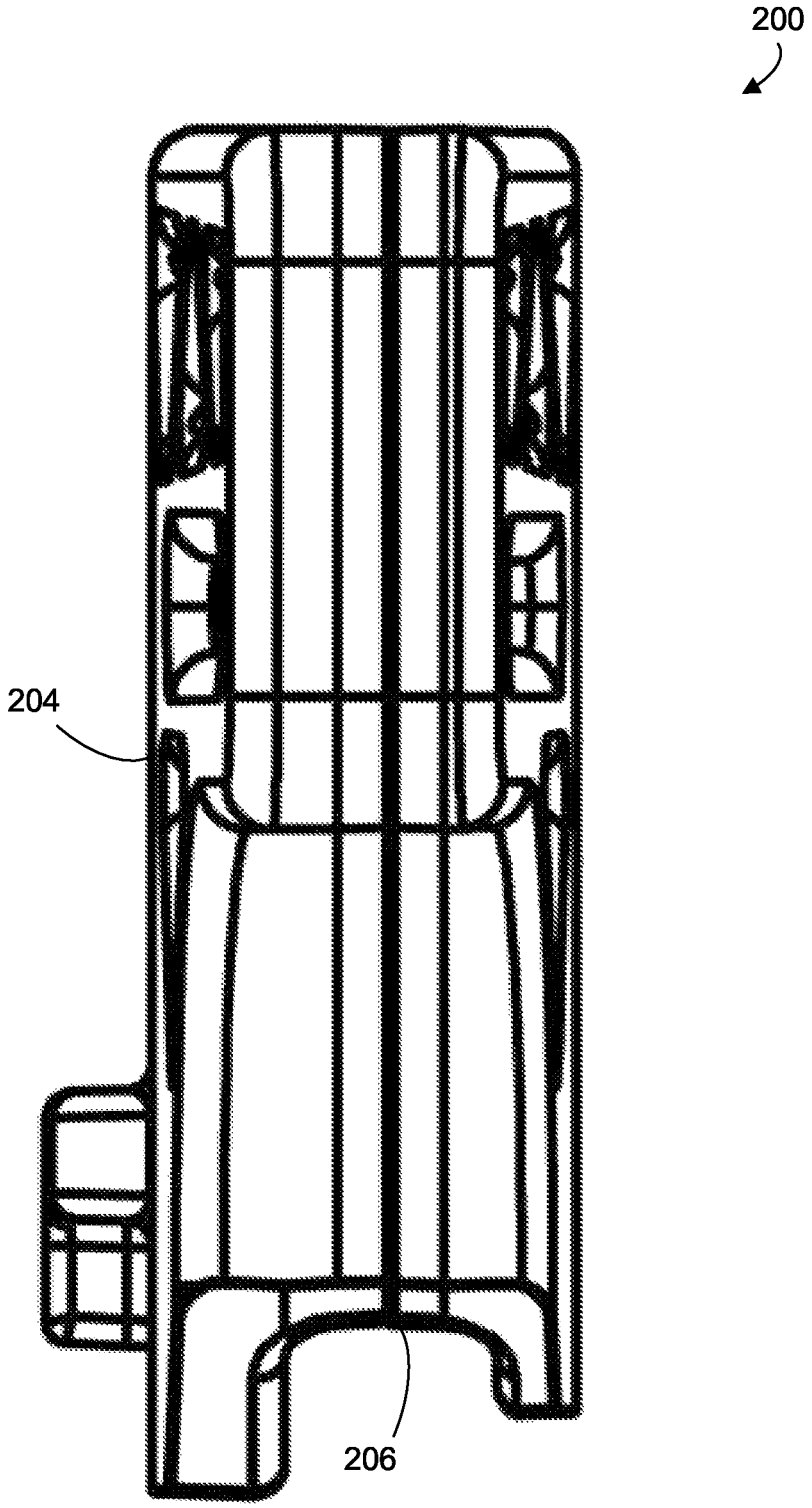
Figure 3A:
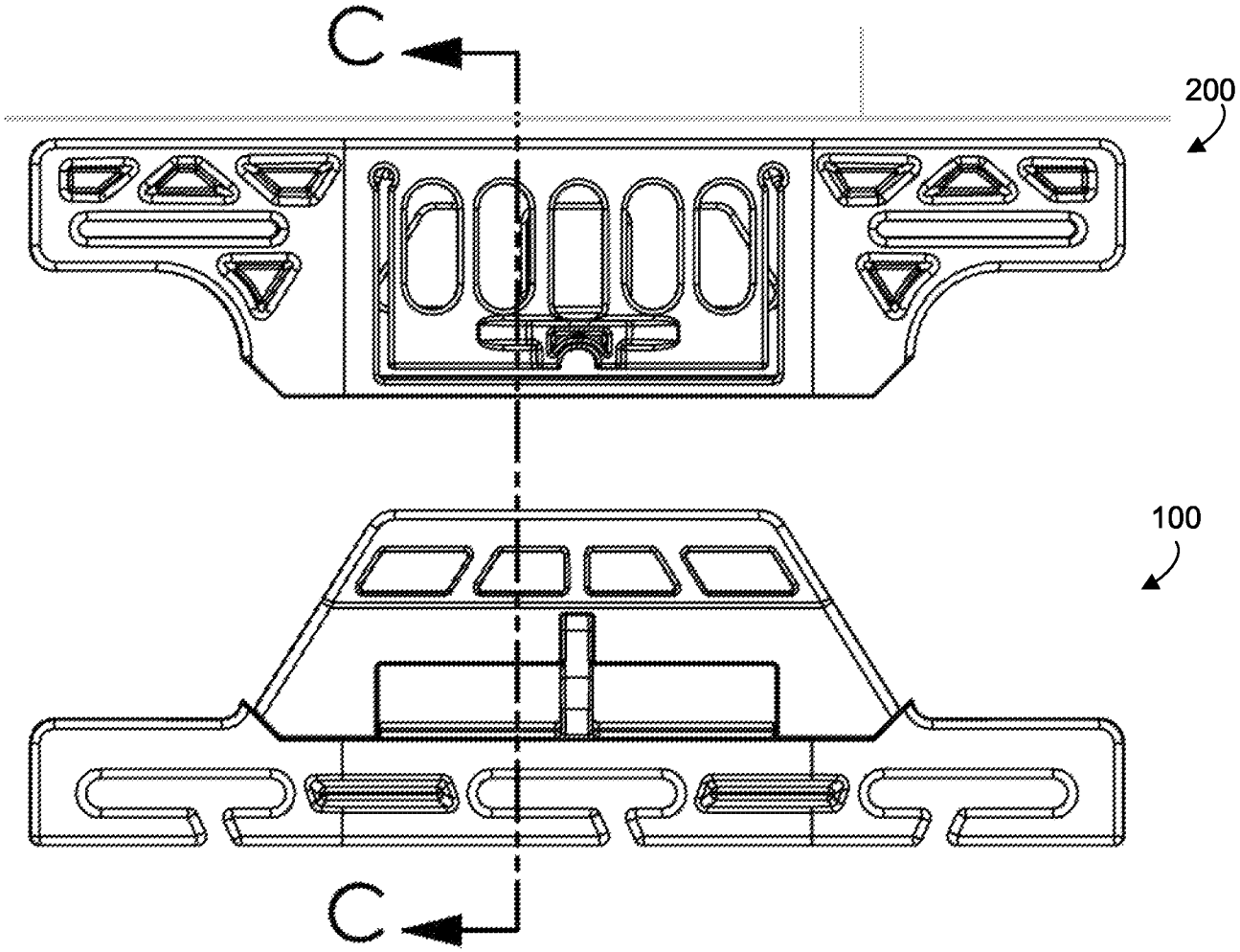
FIG. 3A shows a front view of a male component and female component of a quick-release latch in an unattached position in accordance with one or more embodiments of the present disclosure.
Figure 3C:
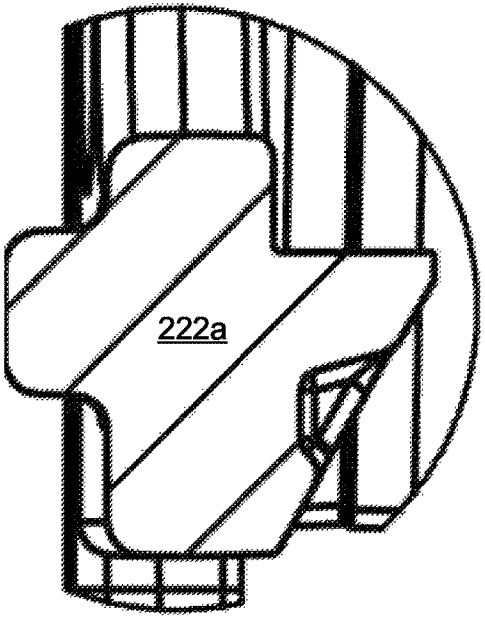
FIG. 3C shows an enlarged view of area E of FIG. 3B.
Figure 3B:
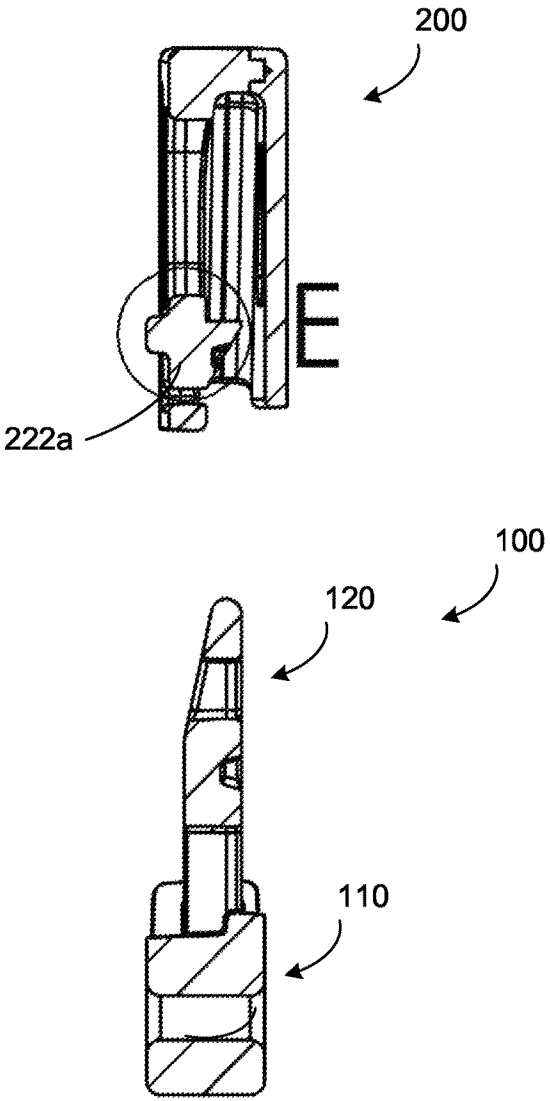
FIG. 3B shows a cut away view along line C-C in FIG. 3A.

As shown in FIGS. 1A and 2A, the male component 100 and the female component 200 may also include one or more through-holes 132, 232 to allow air, water, sand, dirt, and the like, to easily pass through quick-release latch 10.

To connect male component 100 with female component 200, a user may simply insert the blade 120 of the male component 100 into the female receptacle portion 202 of the female component 200 such that one or more protrusions 232 of the cantilever wall 210 engage with and are received by the one or more contact cavities 124 of the blade 120.

To separate male component 100 from female component 200, a user may simply pull on cantilever wall 210 via a string, rope, or the like, tie to the cantilever wall 210 via a hole or the like. The pulling force on female component 200 may cantilever wall 210 from slot 212, and the one or more protrusion 232 one or more contact cavities 124, thus disengaging the two components. The same pulling force may separate the two components perpendicular to a cantilever axis positioned longitudinally across a length of the female component 200. Of course, for proper separation to occur, an anchor force opposite the pulling force would need to take place, such as when male component 100 is anchored to a fixed point, e.g., body armor. That is, when a user pulls on female component 200, portions of the body armor would become separated.

Various embodiments of the male component 100 were subjected to strength tests to determine the strength of the strap attachment section/plurality of strap openings 102*a*, 102*b*, 102*c*. The majority slot strap portions of laterally extending strap slots 104*a,* 104*b,* 104*c* of male component 100 shown in FIGS. 1A and 1B were tested using downward force to simulate a strap being pulled toward the mouth 106*a*. In these tests, the majority slot strap portions of slots 104*a* and 104*c* were positioned distal to a center (towards the outermost edge) of the male component 100 as shown in FIGS. 1A and 1B. However, additional tests were conducted using a modified version of male component 100 where the majority slot straps were positioned nearer the center (away from the outermost edge) of the male component 100. Various thickness of the majority slot strap portions were also tested.

It was found that the male component 100 could withstand a maximum force of 210 psi at the majority slot portions of slots 104*a,* 104*b,* when the majority slot portions positioned distal to the center of the male component 100 as shown in FIGS. 1A and 1B and the majority slot portions have a first exemplary thickness, and a maximum force of 150 psi when the majority slot portions have second exemplary (lesser) thickness in the same configuration. However, the male component 100 could withstand a maximum force of 220 psi at the majority slot portions of slots 104*a,* 104*b* when the majority slot portions are positioned nearer the center of the male component 100 and the majority slot portions have the first exemplary thickness and a maximum force of 160 psi when the majority slot portions have the second exemplary thickness. Similarly, the male component 100 could withstand a maximum force of 265 psi at the majority slot portions of slots 104*a,* 104*b* when the majority slot portions are positioned proximate the center of the male component 100, the majority slot portions have the first exemplary thickness, and the strap attachment section/strap openings 102*c* is eliminated and instead includes molded material. Overall, the male component 100 could withstand a maximum force of at least 150 psi at the majority slot portions of slots 104*a,* 104*b,* 104*c,* according to envisioned designs.

Although certain specific aspects of various example embodiments have been described, many additional modifications and variations would be apparent to those skilled in the art. In particular, any of the various processes described above may be performed in alternative sequences and/or in parallel (on different computing devices) in order to achieve similar results in a manner that is more appropriate to the requirements of a specific application. Thus, embodiments disclosed should be considered in all respects as examples and not restrictive. Accordingly, the scope of the inventions herein should be determined not by the embodiments illustrated, but by the appended claims and their equivalents.

In the present description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing example embodiments, certain terminology is used for the sake of clarity. It is intended that each term contemplates its broadest meaning as understood by those skilled in the art and includes all technical equivalents that operate in a similar manner to accomplish a similar purpose.

While certain embodiments of the disclosed technology have been described, it is to be understood that the disclosed technology is not to be limited to the disclosed example embodiments, but covers various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and to enable any person skilled in the art to practice the disclosed technology, including making and using any devices or systems and performing any incorporated methods. The patentable scope may include other examples that occur to those skilled in the art. Such other examples are intended to be within the scope of the claims if they have structural elements as the claims, or if they include equivalent structural elements with insubstantial differences from the literal language of the claims.

What is claimed is:

1. A quick-release latch comprising:

a male component comprising:

an insertable male portion comprising a top wall, a bottom wall, and one or more sidewalls, at least a portion of the top wall longitudinally tapering towards the bottom wall proximate a front edge; and a first strap attachment portion defining a first plurality of strap openings each having a laterally extending strap slot and a mouth positioned off-center of and providing exterior access to the respective strap slot; and a female component comprising:

a female receptacle portion comprising a top wall, a bottom wall, and one or more sidewalls collectively forming a receptacle configured to receive and releasably lock to the insertable male portion of the male component, the top wall comprising a cantilever wall partially surrounded by one or more slots, the cantilever wall extending proximate a same plane as the top wall; and a second strap attachment portion defining a second plurality of strap openings each having a laterally extending strap slot.

2. The quick-release latch of claim 1, wherein each of the mouths of the first plurality of strap openings bisect each of their respective laterally extending strap slots into a minority strap slot portion and a majority strap slot portion.

3. The quick-release latch of claim 2, wherein each of the mouths of the first plurality of strap openings is angled inwardly towards the majority strap slot portion such that it forms an acute angle with the minority strap slot portion.

4. The quick-release latch of claim 3, wherein the acute angle is between 25 and 85 degrees.

5. The quick-release latch of claim 2, wherein the first plurality of strap openings comprises a left-most strap opening and a right-most strap opening.

6. The quick-release latch of claim 5, wherein the insertable male portion is laterally positioned between the mouth of the left-most strap opening and the mouth of the right-most strap opening of the first strap attachment portion of the male component.

7. A quick-release latch comprising:

a female connector comprising:

a female receptacle body comprising a top wall, a bottom wall, and one or more sidewalls collectively forming a receptacle, the top wall comprising a cantilever wall having one or more downwardly extending contact protrusions; and one or more strap attachment sections positioned adjacent the female receptacle body, the one or more strap attachment sections comprising a laterally extending strap slot; and a male connector comprising:

a base comprising a forward-facing lip, a first strap opening, and a second strap opening, the first strap opening having a first laterally extending strap slot and a first rearwardly-facing mouth positioned off-center of the first strap slot, and the second strap opening having a second laterally extending strap slot and a second rearwardly-facing mouth positioned off-center of the second strap slot; and a blade protruding from the forward-facing lip of the base, the blade comprising a top wall, a bottom wall, and one or more sidewalls, wherein a front portion of the top wall longitudinally tapers towards the bottom wall proximate a front edge and the bottom wall comprises one or more contact cavities configured to engage the one or more contact protrusions of the cantilever wall of the female receptacle body when the blade is fully inserted into the female receptacle body.

8. The latch of claim 7, wherein the one or more strap attachment sections comprises a pair of strap attachment sections laterally positioned on opposing sides of the female receptacle body.

9. The latch of claim 7, wherein:

the first mouth of the first strap opening bisects the first strap slot into a minority first strap slot portion and a majority first strap slot portion; and the second mouth of the second strap opening bisects the second strap slot into a minority second strap slot portion and a majority second strap slot portion.

10. The latch of claim 9, wherein the first mouth is angled inwardly toward the majority first strap portion such that it forms an acute angle with the minority first strap portion.

11. The latch of claim 10, wherein the acute angle is between 25 and 85 degrees.

12. The latch of claim 7, wherein:

outlet and inlet ends of the first mouth are between an innermost edge of first strap slot and a center of first strap slot;

outlet and inlet ends of second mouth are between an innermost edge of second strap slot and a center of second strap slot.

13. The latch of claim 7, wherein the first strap slot is positioned outside of a leftmost bounds of the blade and the second strap slot is positioned outside of a rightmost bounds of the blade.

14. The latch of claim 7, wherein the base is thicker than the blade.

15. The latch of claim 7, wherein the first strap slot and the second strap slot are aligned in a lateral direction.

16. The latch of claim 7, wherein the first mouth has first planar surfaces non-perpendicular to the first strap slot and the second mouth has second planar surfaces non-perpendicular to the second strap slot.

17. The latch of claim 7, wherein the base further comprising a third strap opening positioned on a lateral center of the male connector, the third strap opening having a third laterally extending strap slot and a third rearwardly-facing mouth.

18. The latch of claim 17, wherein the third mouth is positioned off-center of the third strap slot.

19. The latch of claim 7, wherein the one or more downwardly extending contact protrusions of the female connector comprise a laterally-aligned left contact protrusion and a laterally-aligned right contact protrusion positioned off of a central longitudinal axis of the female connector; and the one or more contact cavities of the male connector comprise a laterally-aligned left contact cavity and a laterally-aligned right contact cavity positioned off of a central longitudinal axis of the male connector.

20. A latch comprising:

a female connector comprising:

a female receptacle formed by one or more outer walls comprising a cantilever wall having one or more downwardly extending contact protrusions; and one or more strap attachment sections positioned adjacent the female receptacle, the one or more strap attachment sections comprising a strap slot; and a male connector comprising:

a base comprising a first strap attachment section and a second strap attachment section, the first strap attachment section having a first strap slot and a first rearwardly-facing mouth positioned off-center of the first strap slot, and the second strap attachment section having a second strap slot and a second rearwardly-facing mouth positioned off-center of the second strap slot; and a blade protruding from the base opposite the first and second rearwardly-facing mouths, the blade comprising an outer wall having one or more contact cavities configured to contact the one or more contact protrusions of the cantilever wall of the female receptacle when the blade is at least partially inserted into the female receptacle.

* * * * *